United States Patent [19]

Klubitschko

[11] Patent Number: 4,485,536

[45] Date of Patent: Dec. 4, 1984

[54] HEEL GRIP WITH PEDAL OPERATED SKI BRAKE FOR ROTARY SKI BINDING

[75] Inventor: Gerd Klubitschko, Oberau, Fed. Rep. of Germany

[73] Assignee: Marker-Patentverwertungsgesellschaft mbH, Baar, Switzerland

[21] Appl. No.: 347,225

[22] Filed: Feb. 9, 1982

[30] Foreign Application Priority Data

Feb. 25, 1981 [DE] Fed. Rep. of Germany ..... 3107035

[51] Int. Cl.[3] ..... A63C 7/10

[52] U.S. Cl. ..... 280/605; 280/620

[58] Field of Search ..... 280/620, 605, 618, 626

[56] References Cited

U.S. PATENT DOCUMENTS

| | | | |
|---|---|---|---|
| 3,210,090 | 10/1965 | Keeling | 280/620 |
| 3,610,648 | 10/1971 | Reese | 280/620 |
| 4,101,145 | 7/1978 | Korger | 280/605 |
| 4,171,138 | 10/1979 | Riedel | 280/605 |
| 4,366,968 | 1/1983 | Klubitschko | 280/605 |

FOREIGN PATENT DOCUMENTS

| | | | |
|---|---|---|---|
| 2926822 | 1/1980 | Fed. Rep. of Germany | 280/605 |
| WO80/01760 | 9/1980 | PCT Int'l Appl. | 280/605 |

*Primary Examiner*—David M. Mitchell

*Attorney, Agent, or Firm*—Woodling, Krost, Rust and Hochberg

[57] ABSTRACT

A heel grip for a rotary ski binding having a lever pivotally mounted on a rotary plate for rotation between skiing and braking positions, a pair of brake wings mounted on the lever to move with the lever between skiing and braking positions and being rotatable on the lever between positions inboard and outboard of the ski, and a spring wire connecting member having an intermediate portion connected to a pedal and free end portions connected to the brake wings, the pedal engaging the connecting member between its intermediate and free end portions to deform the connecting member and rotate the wings to their inboard position as the pedal is moved to its skiing position and the latter action being reversed to move the wings to their outboard position as the pedal is moved out of the skiing position.

4 Claims, 3 Drawing Figures

HEEL GRIP WITH PEDAL OPERATED SKI BRAKE FOR ROTARY SKI BINDING

Figure 1:
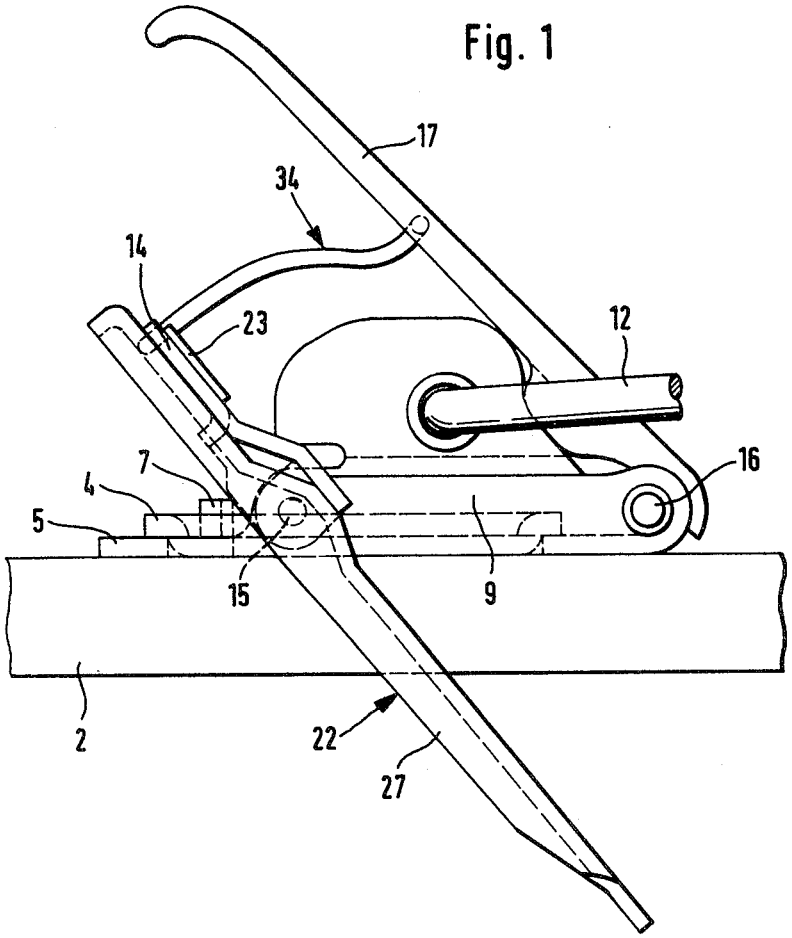

This invention relates to a heel grip for safety ski bindings, comprising a rotary plate for supporting the heel of the skiing boot, two tensile elements extending on opposite sides of the heel of the skiing boot and pivoted to said rotary plate, a soleholder, which is carried by said tensile elements and movable against the force of at least one spring, and ski stop.

In a heel grip of that kind which is known from German Opened Application No. 29 06 726, a baseplate is secured to the ski and carries the rotary plate and defines a transverse horizontal pivot and the ski stop comprises a pedal, which is pivoted to said pivot and is pivotally movable against the force of at least one spring to a position in which the pedal extends over the rotary plate and is at least approximately parallel to the baseplate. A lever which constitutes a brake spur is pivoted to the pedal on a pivot that is parallel to said horizontal transverse pivot. One arm of said lever is guided along the ski in an eyelet secured to the ski.

Compared to other known heel grips, that heel grip affords the advantage that it permits the skier to step into the binding without a previous manipulation and that the ski stop automatically assumes braking position and does not adversely affect the function of the safety ski binding. A disadvantage of that heel grip resides in that when the brake wings of the ski stop are ineffective, during skiing, they are disposed above the surface of the ski but outside the width of the ski so that the brake wings may be caught by an obstacle. This involves a risk of a fall particularly when the skier holds the skis parallel to each other and only closely spaced apart.

It is an object of the present invention so to improve and alter the heel grip of the kind described first hereinbefore that the ski stop cannot be caught by an obstacle.

This object is accomplished according to the invention in that the rotary plate is connected to the ski by a retaining plate, which is secured to the surface of the ski and permits of a limited pivotal movement of the rotary plate to both sides from an intermediate position on an axis which is at right angles to the surface of the ski, the ski stop is integrated in the rotary plate and comprises in a manner known per se a two-armed lever, which is pivoted on an axis which in the intermediate position of the rotary plate is at least approximately at right angles to the longitudinal axis of the ski, one arm of said lever is operable by a pedal, which is operable by the skiing boot and is mounted on the rotary plate on an axis that is parallel to the pivotal axis of said lever, the other arm of said lever is divided and forms two brake wings disposed on the outside of the ski, the ski stop is spring-loaded so that it automatically assumes its braking position when the skiing boot has been removed from the ski, whereas in the effective position of the ski stop the two brake wings are disposed above and parallel to the surface of the ski and are pulled toward each other, the brake wings are rotatably connected to the pedal-operable arm of the lever on respective pivots, which extend at right angles to the plane of that arm, which plane is substantially radial to the pivotal axis of the lever, the pedal is connected to the brake wings at points which are spaced from the pivots connecting the brake wings to the lever arm so that when the pedal-operable lever arm is parallel to the surface of the ski the pedal is adapted to impart a pivotal movement to said brake wings relative to said pedal-operable lever arm, and the brake wings in their braking position are spaced apart so that in a limiting position of the rotary plate the brake wing which has been pivotally moved toward the ski is at least approximately parallel to the ski.

The rotary plate can be rotated through such a large angle that the toepiece can always release the skiing boot in response to an application of an excessive force as a result of a twisting fall. The integration of the ski stop in the rotary plate affords the advantage that those parts of the heel grip which are disposed under the sole of the skiing boot have only a small overall height.

If the ski stop of the heel grip comprises a link by which the pedal is connected to the brake wings, said link may consist, in accordance with another feature of the invention, of a U-shaped spring wire, which has a crosspiece that is pivoted to the pedal and legs which at their free ends are connected to the brake wings. That feature results in a simple design, which is reliable in operation. Without need for special bearing elements, the free ends of the U-shaped spring wire can simply be hooked into suitable holes in the brake wings. The holes are preferably disposed in the brake wings in lugs which are angled toward the pedal.

It has been found that the pivot which carries the pedal carries desirably at least one helical torsion spring, which bears at one end on the rotary plate and at the other end on the pedal and moves the ski stop to its braking position as the skiing boot is removed from the ski. The provision of such torsion spring affords the advantage that it does not require a large space and may be so weak that a movement of the pedal against the force of said spring does not greatly increase the force which in the closed binding acts by means of the sole of the boot on the heel grip in a releasing sense.

Figure 2:
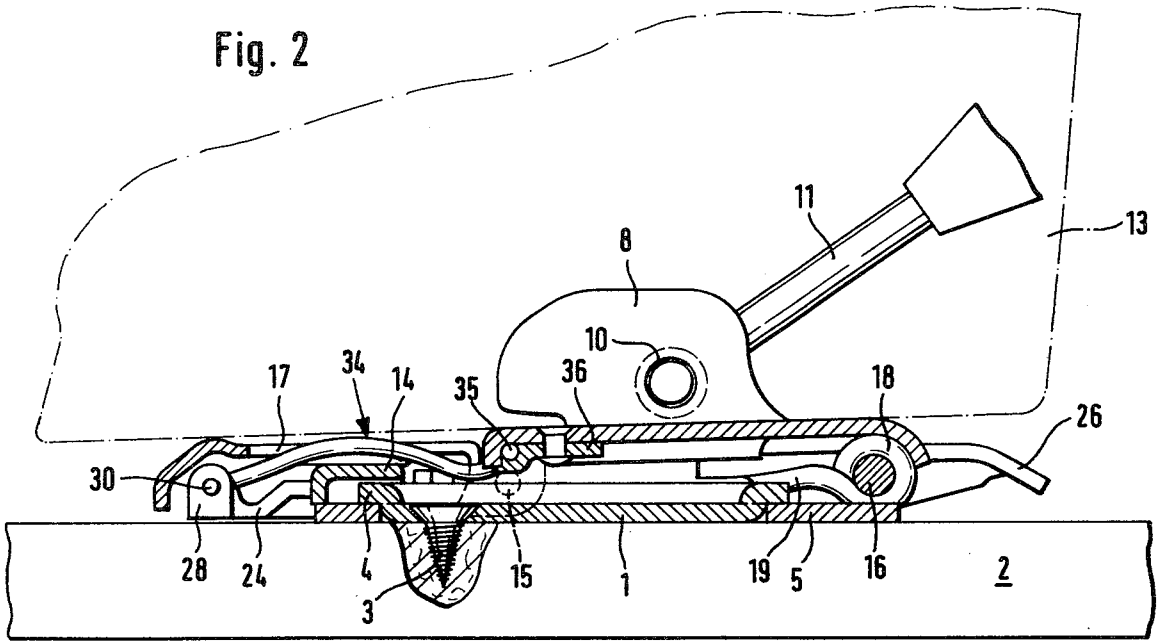
Figure 3:
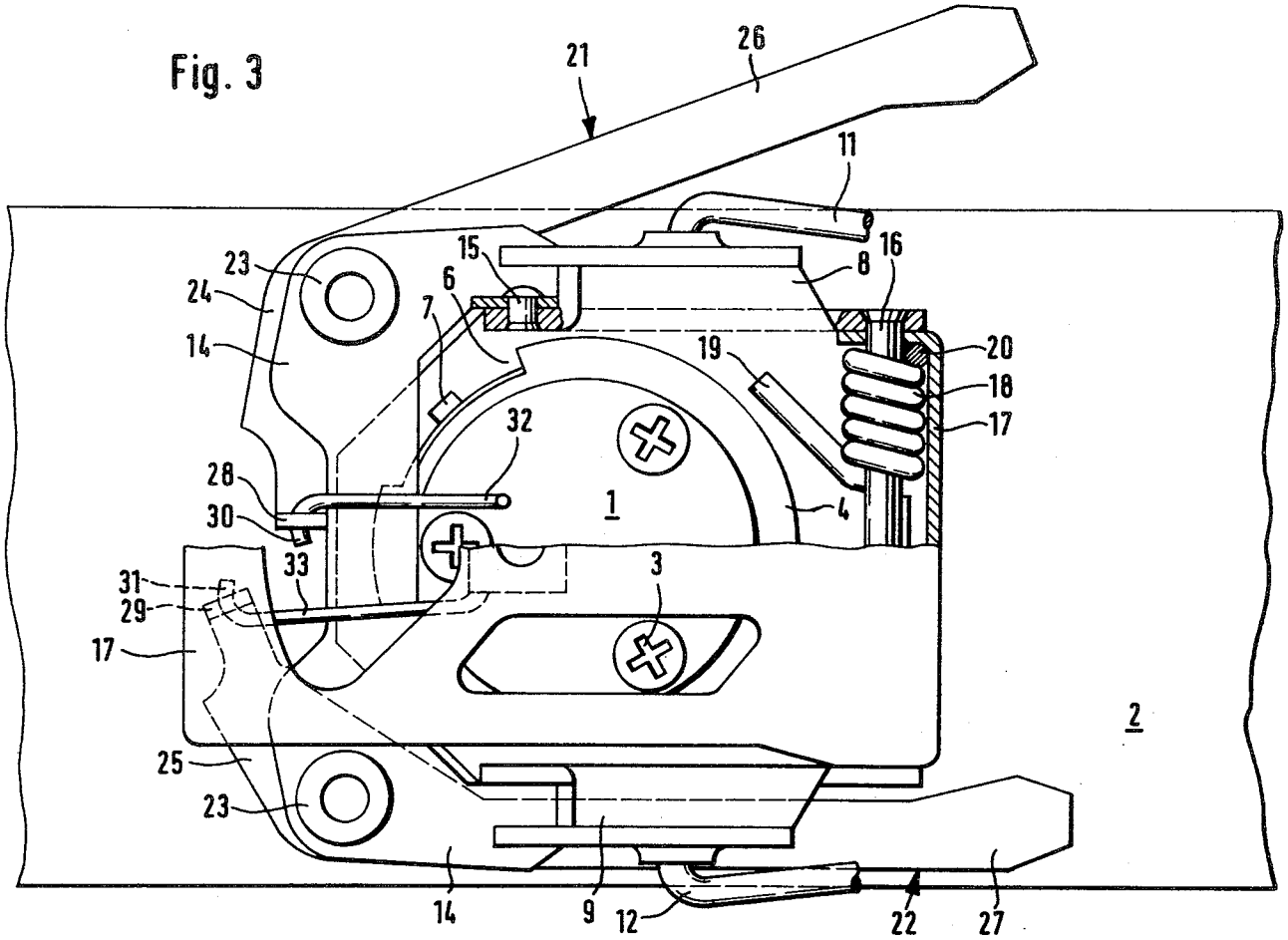

An illustrative embodiment of the heel grip according to the invention will now be described with reference to the accompanying drawings, in which:

FIG. 1 is a side elevation showing that part of the heel grip which is to be mounted on the ski, with the ski stop in braking position, FIG. 2 is a central longitudinal sectional view showing the heel grip of FIG. 1 in operative position, and FIG. 3 is a top plan view showing in its lower half the ski stop in braking position, shown in FIG. 2, whereas the upper half, in which the pedal is omitted, shows an instantaneous position which is assumed during the movement from the position of FIG. 2 to the position of FIG. 1 or vice versa and in which the brake wings are still parallel to the ski.

The heel grip is mounted on a ski 2 in conventional manner by means of a retaining plate 1, which is fixed to the ski by means of screws 3 and has an off-set flange 4, which extends over the rim of a circular hole in a rotary plate 5, which is rotatable on an axis that is defined by the retaining plate 1. The flange 4 comprises two recesses 6, which are symmetrical with respect to the longitudinal axis of the ski and receive respective noses 7 of the rotary plate so that the length of each recess determines the angle through which the rotary plate can be rotated relative to the retaining plate and the ski 2. That angle is so large that the rotary plate can follow a pivotal movement of the skiing boot until the latter is released by a toepiece, not shown, in response to the application of an excessive force which is due to a twisting fall.

The rotary plate has two upwardly angled cheeks 8, 9, each of which has a hole 10. Tie rods 11 and 12 are hooked into respective ones of the holes 10 and when the skiing boot has been inserted into the binding extend past the sides of the heel of the skiing boot. The rear end 13 of a skiing boot is indicated in phantom in FIG. 2. That part of the heel grip which is connected to the tie rods is no part of the present invention and may be designed in accordance with the showing and description of such part given in German Opened Application No. 25 05 312.

The free leg ends of a substantially U-shaped member 14 are pivoted by rivets 15 to the cheeks 8,9 on the left of the holes 10 as shown in the drawings. That U-shaped member constitutes one lever arm of the ski stop. A pivot 16 which is parallel to the rivets 15 is mounted in the cheeks 8, 9 on the right of the holes 10 and carries a pedal 17, which extends over the retaining plate 1. Under the pedal, two helical torsion springs are mounted on the pivot 16. One of said torsion springs is shown in FIG. 3 and designated 18. The leg 19 of the spring 18 bears on the rotary plate 5. The other leg 20 of the spring 18 bears on the pedal 17 and biases the latter in the clockwise sense in FIG. 1.

Bellcrank levers 21, 22 are pivoted by hollow rivets 23 to the ends of the crosspiece of the U-shaped member 14. The two bellcrank levers are arranged in mirror symmetry and their shorter arms 24, 25 extend toward each other. The hollow rivets which constitute pivots for the bellcrank levers extend at right angles to the principal plane of the U-shaped member 14 so that the bellcrank levers are virtually parallel to said member 14. As a result, the brake wings formed by the longer arms 26, 27 of the bellcrank levers cross the pivotal axis of the member 14; that axis is defined by the rivets 15. Each of the short arms 24, 25 has at its free end a lug 28 or 29, which is angled from the pedal 17. Each of these lugs has a hole, which receives an angled end portion 30 or 31 of one of the legs 32, 33 of a U-shaped spring wire 34. The spring wire 34 has a crosspiece 35, which is connected to the pedal 17 by strap 36, which is riveted to the pedal. The spring wire 34 thus constitutes a link between the pedal 17 and the bellcrank levers 21, 22, which are pivoted to the lever that is formed by the U-shaped member 14.

As the skiing boot is inserted into the binding, the ski stop is moved from its braking position, shown in FIG. 1, to its ineffective position, which is shown in FIG. 2 and in which the ski stop is held by the skiing boot. If the actual binding part of the heel grip is not automatically closed in response to the insertion of the skiing boot, the heel grip must be closed by hand in known manner.

The ski stop is moved in two phases from its braking position to its effective position and vice versa. When the skiing boot is inserted into the binding when the latter is in the position shown in FIG. 1 the sole of the skiing boot engages the pedal 17 so that the latter is turned in a counterclockwise sense in the drawing about the pivot 16. As a result, the U-shaped spring wire 34 turns the U-shaped member 14 about its pivotal axis, which is defined by the rivets 15, until the pivotal movement of the U-shaped member 14 is limited by the engagement of that member with the surface of the ski 2 and the member 14 is now parallel to the surface of the ski. The pivotal axes are so disposed that the pedal 17 is still slightly inclined in that position. As the pedal is further depressed, the spring wire 34 is extended as in a toggle joint until the parts assume the position shown in FIG. 2. The ski stop is shown in an intermediate position in the upper half of FIG. 3 and in its effective position in the lower half of FIG. 3. A comparison of both halves of FIG. 3 reveals that the final depression of the pedal causes the two bellcrank levers 21, 22 to be turned by the wire 34 about their pivots 23, which are formed by the hollow rivets. The leg 32 shown in the upper half and the leg 33 shown in the lower half of FIG. 3 are opposite to each other. This rotation of the bellcrank levers causes an inward pivotal movement of the arms 26, 27, which constitute the brake wings.

A simple and functionally reliable structure has been provided because the angled ends 30, 31 of the legs 32, 33 of the spring wire 34 enter the holes in the lugs 28, 29 provided at the free ends of the lever arms 24, 25.

Under the influence of the torsion springs 8 which bias the pedal 17, the ski stop assumes its braking position, shown in FIG. 1, in response to an arbitrary or automatic release of the skiing boot from the ski. As mentioned above, this movement to the braking position comprises also two phases. In the first phase, the brake wings 26, 27 are turned outwardly. In the second phase, the U-shaped member 14 is turned up about its pivotal axis 15. From the upper half of FIG. 3 it is apparent that when the skiing boot has been removed the brake wings 26, 27 are spread apart to such an extent that the ski stop will be effective also when the rotary plate 5 has been turned laterally on the retaining plate 1. As has been stated, the rotary plate can assume that position when the toepiece has released the skiing boot in response to a twisting fall.

What is claimed is:

1. A heel grip for a safety ski binding for mounting on a generally planar ski having a longitudinal axis, said heel grip comprising:

a retaining plate mountable on the ski;

a rotary plate rotatably mounted on said retaining plate for rotation relative to said retaining plate about an axis normal to the ski plane, said retaining plate and said rotary plate having cooperating means for limiting the range of rotation of said rotary plate, said cooperating means including a recess in said retaining plate which receives a nose in said rotary plate;

a pedal pivotally mounted on said rotary plate for rotation about an axis transverse to the rotational axis of said rotary plate and parallel to the ski plane between a non-skiing position spaced from said rotary plate and a skiing position adjacent said rotary plate;

spring means biassing said pedal away from said rotary plate;

a ski brake pivotally mounted on said rotary plate, said ski brake comprising a lever pivotally attached to said rotary plate for rotation about a braking axis parallel to and forward of the axis of said pedal between a braking position and a skiing position, a pair of braking wings pivotally mounted at spaced positions on said lever for rotation with said lever between the braking position wherein said braking wings extend beneath the plane of the ski and the skiing position wherein the braking wings are disposed above the plane of the ski, said braking wings being pivotal about parallel axes transverse to the rotational axis of said lever between positions outboard of the ski and inboard of the ski, and connecting means having free end portions connected respectively to said braking wings for rotating said braking wings about their respective parallel axes, said connecting means being movable in response to movement of said pedal from its non-skiing position towards its skiing position to move said lever from its braking position to its skiing position and said connecting means being further movable in response to the movement of said pedal to its skiing position to rotate said braking wings to the inboard positions, and said connecting means rotating said braking wings to the outboard positions in response to movement of said pedal out of the skiing position.

2. The invention according to claim 1 wherein said braking wings have diverging free end portions when in the braking position to assure maintenance of said wings in the braking position through the range of rotation of said rotary plate.

3. The invention according to claim 1 wherein said connecting means comprises a U-shaped spring wire, and said intermediate portion comprises a crosspiece pivotally connected to said pedal, and said free end portions comprise the free ends of legs extending from said crosspiece.

4. The invention according to claim 1 and further including a pedal axle defining the rotational axis of said pedal and on which said pedal is mounted, and wherein said spring means comprises a helical torsion spring having one end bearing on the rotary plate and another end bearing on the pedal for biassing said pedal towards the non-skiing position.

* * * * *